US010160584B2

(12) United States Patent
Yi

(10) Patent No.: US 10,160,584 B2
(45) Date of Patent: Dec. 25, 2018

(54) HAIR WEAVE AND EXTENSION MATERIAL PACKAGING

(71) Applicant: Sky Trading, LLC, Blythewood, SC (US)

(72) Inventor: Jay Sky Yi, Blythewood, SC (US)

(73) Assignee: Sky Trading, LLC, Blythewood, SC (US)

( * ) Notice: Subject to any disclaimer, the term of this patent is extended or adjusted under 35 U.S.C. 154(b) by 47 days.

(21) Appl. No.: 14/598,604

(22) Filed: Jan. 16, 2015

(65) Prior Publication Data

US 2016/0206030 A1 Jul. 21, 2016

(51) Int. Cl.

| | |
|---|---|
| ***A41G 5/00*** | (2006.01) |
| ***B65D 77/26*** | (2006.01) |
| ***B65D 85/00*** | (2006.01) |
| ***B65D 73/00*** | (2006.01) |
| ***B65D 30/00*** | (2006.01) |
| *B65D 33/14* | (2006.01) |
| *B65D 33/24* | (2006.01) |

(52) U.S. Cl.

CPC ..... *B65D 77/26* (2013.01); *B65D 29/00* (2013.01); *B65D 73/0014* (2013.01); *B65D 85/70* (2013.01); *A41G 5/00* (2013.01); *B65D 33/14* (2013.01); *B65D 33/24* (2013.01)

(58) Field of Classification Search

CPC .... A41G 5/004; B65D 73/0014; B65D 77/26; B65D 85/70

See application file for complete search history.

(56) References Cited

U.S. PATENT DOCUMENTS 578,623 A * 3/1897 Borden ..... A41G 3/00 132/53
1,657,413 A * 1/1928 Schumer ..... A45D 44/005 206/457
1,801,751 A * 4/1931 Mills ..... A45D 44/005 206/486
3,029,852 A * 4/1962 Taylor ..... A45C 3/00 383/16
3,034,195 A * 5/1962 Leclabart ..... A46D 1/08 174/90
3,702,508 A * 11/1972 Netter ..... G09F 5/04 206/388
5,121,761 A * 6/1992 Meister ..... A41G 5/0053 132/201
5,595,199 A * 1/1997 Solomon ..... A45D 8/00 132/273
5,609,484 A * 3/1997 Hawiuk ..... A45D 44/005 434/94
D385,701 S * 11/1997 Bagaria ..... D3/301

(Continued)

*Primary Examiner* — Anthony Stashick
*Assistant Examiner* — James Way
(74) *Attorney, Agent, or Firm* — McNair Law Firm, P.A.; Hunter S. Freeman

(57) ABSTRACT

The present invention is directed to packaging for hair weave-extension materials that can include a container having a top portion used for storage and display of the hair weave-extension material and a bottom opening for receiving the hair weave-extension material. A top cavity can receive the head of the hair weave-extension material so that the top of the hair weave-extension material is disposed below the top portion. A cinch can be included disposed beneath the top cavity and is operatively associated with the container and the tie of the hair weave-extension materials in order to secure the hair weave-extension material in the storage area. The hair weave-extension material can be replaceably removed from the storage area.

7 Claims, 4 Drawing Sheets

(56) References Cited

U.S. PATENT DOCUMENTS

| | | | | | |
|---|---|---|---|---|---|
| 5,727,575 | A * | 3/1998 | Rontal | A45D 8/34 | 132/200 |
| 6,237,761 | B1 * | 5/2001 | Godshaw | A45C 3/004 | 206/278 |
| 6,581,609 | B2 * | 6/2003 | Ott | A41G 3/00 | 132/201 |
| 6,938,766 | B1 * | 9/2005 | Lee | A47F 5/02 | 206/388 |
| 7,458,383 | B2 * | 12/2008 | Song | A41G 5/004 | 132/201 |
| 8,061,366 | B2 * | 11/2011 | Britton | A45D 8/36 | 132/200 |
| 8,590,543 | B2 * | 11/2013 | Goff | A41G 5/008 | 132/212 |
| 8,695,792 | B2 * | 4/2014 | Choi | A45D 44/005 | 206/8 |
| 8,939,286 | B2 * | 1/2015 | Hesse | B44D 3/125 | 206/361 |
| 2003/0159962 | A1 * | 8/2003 | Heo | B65D 73/0071 | 206/461 |
| 2010/0154815 | A1 * | 6/2010 | Chang | A41G 5/0066 | 132/201 |
| 2011/0284397 | A1 * | 11/2011 | Batres | A45C 11/24 | 206/8 |
| 2012/0111742 | A1 * | 5/2012 | Choi | A45D 44/005 | 206/8 |
| 2013/0206628 | A1 * | 8/2013 | Batres | A45C 11/26 | 206/457 |
| 2014/0128908 | A1 * | 5/2014 | DeAngelis | A41G 5/0073 | 606/204.35 |
| 2015/0223537 | A1 * | 8/2015 | Kim | A41G 5/004 | 206/581 |
| 2015/0351574 | A1 * | 12/2015 | Eslami | A47G 29/08 | 206/388 |

* cited by examiner

HAIR WEAVE AND EXTENSION MATERIAL PACKAGING

BACKGROUND OF THE INVENTION

1) Field of the Invention

The present invention relates to a novel and improved hair package for storing, displaying, and transporting hair.

2) Description of Related Art

Hair extensions are hair appliances that are used to lengthening an individual's existing hair by incorporating artificial hair or natural hair into the individuals' hair. If the added hair is natural, it can be obtained from other individuals. Additionally, there is the hair weave. The hair weave is a treatment offered in many salons that provides clients with the look and feel of longer or thicker hair. The reason that this treatment is referred to by this name is that artificial or natural human hair purchased by the salon client is woven into the client's natural hair, quite close to the scalp.

When selecting the material for a hair weave, it is important to consider several factors that include style, hair type, color, durability, texture and the like. When packaged, the hair material for use with weaves and extensions typically is bundled and secured to packaging. Once the hair material is removed from the packaging, it cannot be replaced and therefore, there is a strong incentive for the retailer not to remove the hair material from the packaging. This creates a disadvantage to the customer that is unable to compare the hair material with existing hair to make a purchasing decision.

Additionally, providers of hair material offer refund for purchases, but condition the refund with "Yes, we are pleased to offer a return policy on unopened hair extensions." Additionally, when the hair material is bumbled by being secured in the package, removing the hair from the packaging cause the hair material to become unbundled. This gives rise to providers of hair material to make statements such as "we do not accept returns or exchanges of unbundled hair".

The inability to remove and replace the hair material from the packaging also creates the disadvantage of the user being unable to store the hair material after purchase. If the hair material is removed from the original packaging, the hair material is unable to be stored. Attempts to resolve this issues failed to provide the ability to use the original packaging. For example, United States Patent Application 2011/0284397 is directed to a hair carrier clutch bag for storing and transporting hair products such as wigs or hair extensions including an elongated body having a top, a bottom, a first side, a second side, an inner surface, and an outer surface, wherein the elongated body includes a plurality of fold sections and a top overlap section. Using such a device would not provide for a proper display if the sides are folded preventing viewing of the hair material for retail display.

Accordingly, it is an object of the present invention to provide for a packaging apparatus allowing hair weave-extension material to be displayed, stored, removed, and replaced in the packaging apparatus.

SUMMARY OF THE INVENTION

The above objectives are accomplished according to the present invention by providing a combination hair weave-extension material with a packaging apparatus for hair weave-extension materials comprising: a hair weave-extension material having an head, tie, and loose end, and having a bundled configuration and loose configuration; a container for receiving the hair weave-extension material having a front panel and a back panel defining a storage area; a top cavity included in the storage area to receive the head of the hair weave-extension material when the hair weave-extension material is in a bundled configuration; a cinch included in the container disposed beneath the top cavity having an open position and a closed position so that when in the closed position, the cinch is operatively associated with the container and the tie of the hair weave-extension materials to secure the hair weave-extension material in the storage area, and when in the open position, the hair weave-extension material can be removed from the storage area so that the hair weave-extension material can be easily removed from the storage area and replaced in the storage area; a bottom cavity included in the storage area for receiving the loose end of the hair weave-extension material; an opening defined below the bottom cavity allowing the hair weave-extension material to be placed in and removed from the storage area; a flap attached to the container for covering the opening in a closed position; a top portion attached to the container disposed above the top cavity having a hanger opening defined in the top portion for use in storing and displaying the container, and hair weave-extension material in a sales environment; and, an insert included in the storage area having product information directed to the hair weave-extension material.

The invention can include a set of cinch opening extending through the container included in the cinch for receiving a rope that encircles the container and encircles the tie of the hair weave-extension material when the hair weave-extension material is in the container; and, a toggle spring stop for receiving the ends of the rope to secure the rope in a closed position. Elastic can be included in the cinch biasing the cinch in a closed position for securing the hair weave-extension material in the container. Cinch tabs can be included for extending the elastic and placing the cinch in the open position to replace the hair weave-extension material in the container. A strap can encircle the container and encircle the tie of the hair weave-extension material when the hair weave-extension material is in the container. A hook and loop fastener can be operatively associated with the strap to secure the strap in the closed position. A buckle can be attached to the strap to secure the strap in the closed position.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 2:
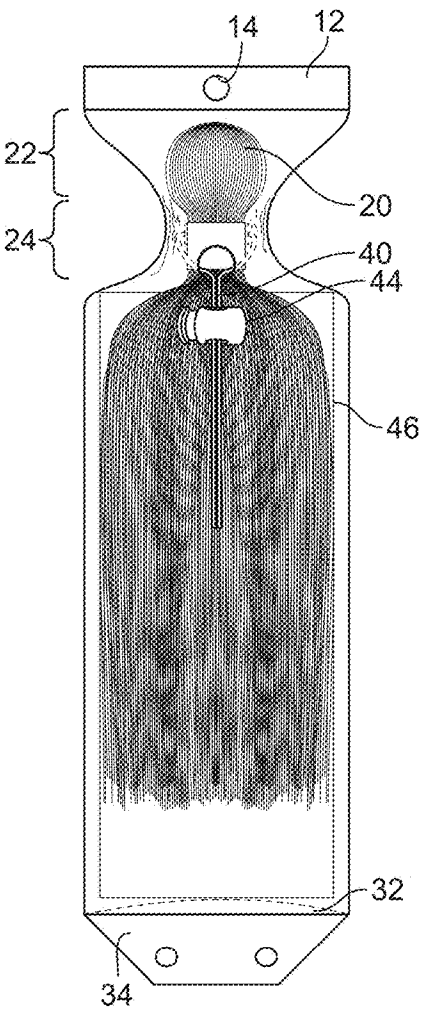
FIG. 2 is a front view of aspects of the invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits, and advantages will be apparent from the above in conjunction with the accompanying examples, data, figures, and all reasonable inferences to be drawn therefrom, alone, or with consideration of the references incorporated herein.

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Figure 1:
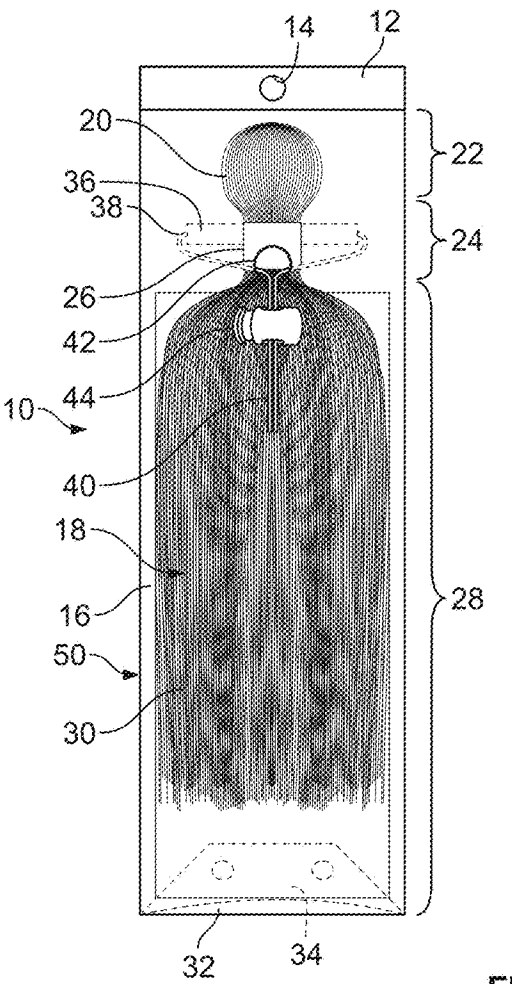
FIG. 1 is a front view of aspects of the invention.

Referring to FIG. 1, the invention will be described in more detail. A container 10 includes a top portion 12 having a hanger opening 14 for hanging the container for storage or display. When selecting hair weave-extension material, the purchaser is most concerned that the hair weave-extension material has not been damaged and in otherwise free from defects. Therefore, proper storage and display is important. The container defines a storage cavity 16 for receiving a hair wave-extension material shown generally as 18 (see FIG. 8). The head 20 of the hair weave-extension material is received in a top cavity 22. A front panel 50 can be included in the invention. The front panel can be opaque or transparent or semi-transparent. In order to illustrate the components of the invention, FIGS. 1 and 2 illustrate the invention with a transparent front panel and opaque rear panel.

Disposed beneath the top cavity is the cinch 24 that can include an open and a closed position. The open position allowed the head of the hair weave-extension material to pass through the cinch into the top cavity. When the cinch is in a closed position, the cinch either partially or completely encloses the tie 26 of the hair weave-extension material, to secure the hair weave-extension material in the container. Because the tie is of a smaller diameter than that of the head, the hair weave-extension material is secure in the container. The loose end 30 of the hair weave-extension material is disposed in a bottom cavity 28 included in the container. A bottom opening 32 can be used to allow the hair weave-extension material to be inserted into the container. A flap 34 can be included to close the bottom opening. The flap can be secured to the container in the closed position using snaps, hook and loop fasteners, buttons or other releasable closing members.

The cinch can include a cinch spacer 36 that can be integrated on an inner surface of the back panel of the invention. The cinch spacer can define a cinch opening 38, for receiving a rope 40, that extends through front cinch opening 42, travels in the cavity, through the cinch opening, and back through the front cinch opening. When the rope is pulled, the diameter of the cinch decreases around the tie of the hair weave-extension material securing the hair weave-extension material in the container. In one embodiment, the rope can be tied to secure it in a closed position. In one embodiment, a spring toggle stop 42, can be used to secure the rope in a closed position.

Referring to FIG. 2, the invention is shown in a closed position where the cinch is secured around the tie of the hair weave-extension material holding the hair weave-extension material in the container. By loosening the cinch, the hair weave-extension material can be removed from the container. When replacing the hair weave-extension material in the container, the cinch can be tightened to secure the hair weave-extension material in the container. In one embodiment, an insert 46 can be included and received in the container with product information.

Figure 3:
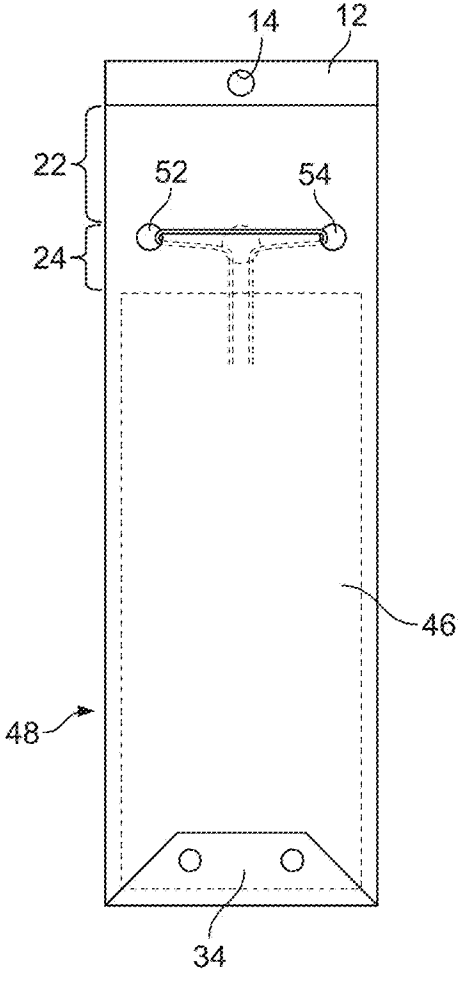
FIG. 3 is a rear view of aspects of the invention.

Referring to FIG. 3, the back of the invention is shown. The flap is shown in a closed position and the insert can be present disposed behind the hair weave-extension material so that the product information can be viewed through a transparent back panel 48. In one embodiment, the rope can extend through a first rear cinch opening 52, travel along the exterior of the container, and through a second rear cinch opening 54. When the rope is pulled, the rear opening is forced together causing the diameter of the cinch to be reduced. In one embodiment, there can be two front opening generally adjacent to each other allowing the rope to extend into the interior of the container.

Figure 4:
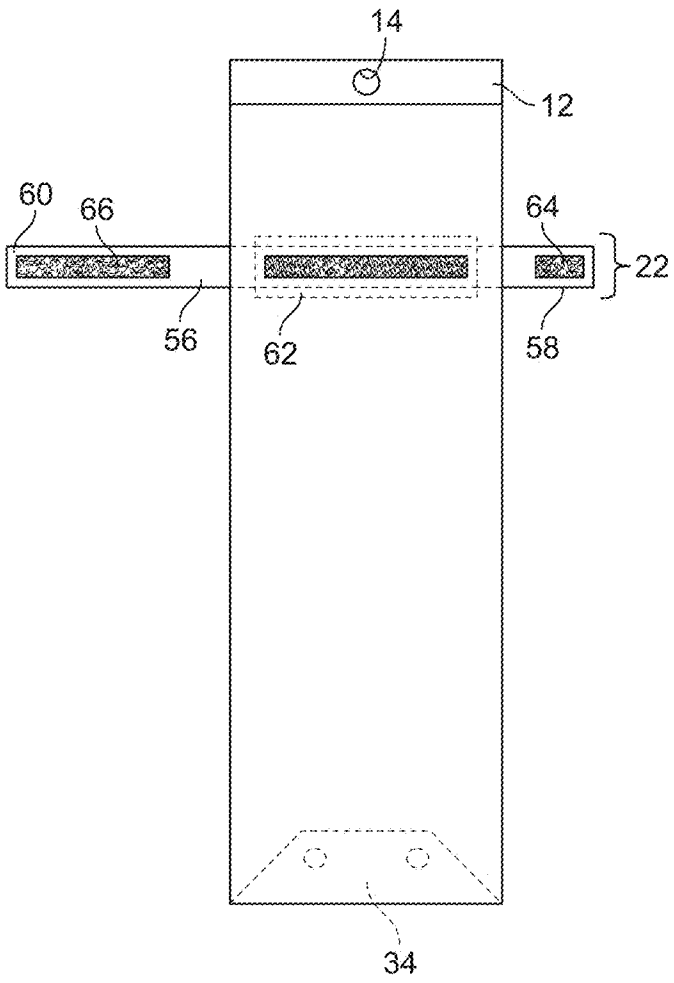
FIG. 4 is a front view of aspects of the invention.

Referring to FIG. 4, an embodiment is shown wherein a strap shown generally at 56 is included in the cinch. The strap can include a proximal end 58 and a distal end 60. A loop patch 62 portion of a hook and loop fastener, can be attached to the exterior of the front panel and removably attached to the a hook patch 64 attached to the distal end, and a hook patch 66 attached to the proximal end. When the strap is pulled, the diameter of the cinch is reduced and the strap can be secured in the closed position by the hook and loop fasteners. In one embodiment, the hook and loop patches are reversed so that hook patches are attached to the front panel and the loop patches are attached to the strap. In one embodiment, one portion of the hook and loop fastener is attached to the back of the distal end and the other portion of the hook and loop fastener is attached to the front of the proximal end of the strap, so that when the straps are tightened, the ends are removable, connected to each other, and secured in a closed position. The strap can be attached to the rear panel or can extend through the cinch opening. The strap can also extend through the rear and front cinch openings that can be slotted in this configuration.

Figure 5:
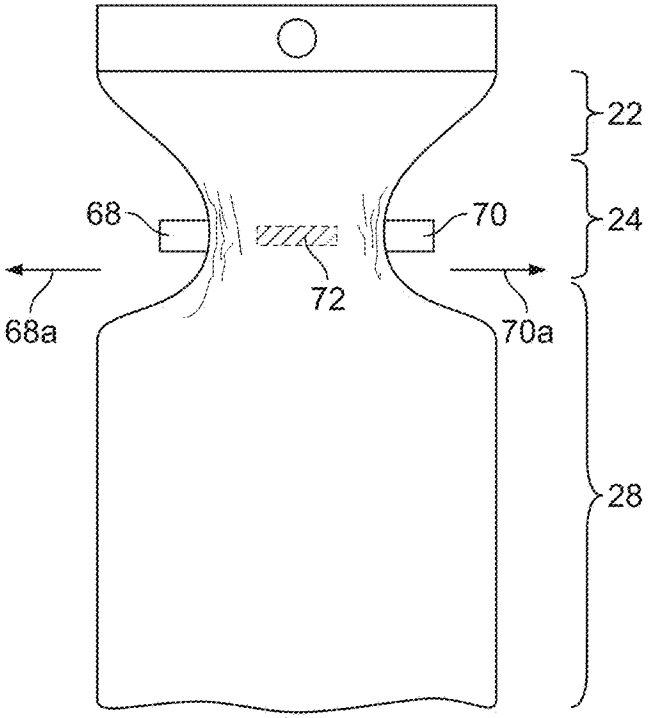
FIG. 5 is a front view of aspects of the invention.

Referring to FIG. 5, one embodiment is shown having the cinch area including cinch tabs 68 and 70. Tab 68 can be pulled in a direction 68*a* to open the cinch are allowing the hair weave-extension material to be released from the cinch. Tab 70 can be pulled in a direction shown as 70*a* to open the cinch are allowing the hair weave-extension material to be released from the cinch. A cinch elastic member 72 can be carried by the container to bias the cinch in a closed position. The elastic member can be attached to the front or back panel, integrated into the front or back panel or be disposed in the exterior of the container.

Figure 6:
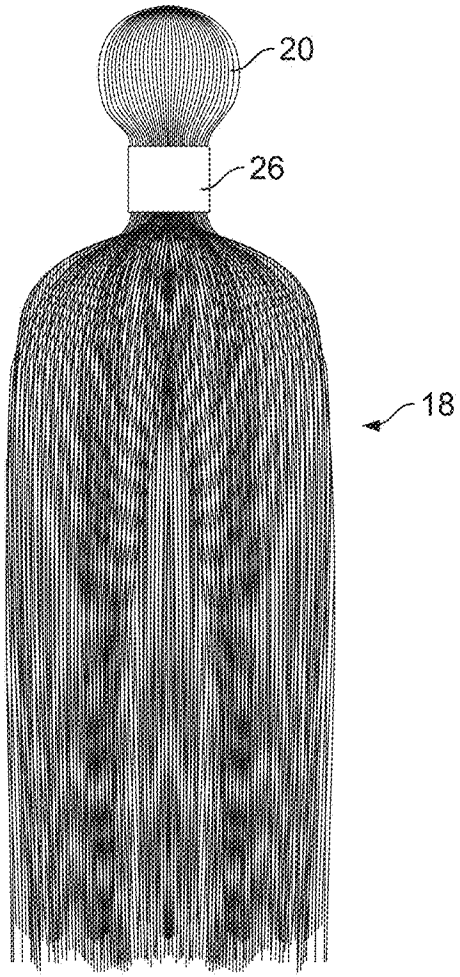
FIG. 6 is a front view of a hair weave-extension material.
Figure 8:
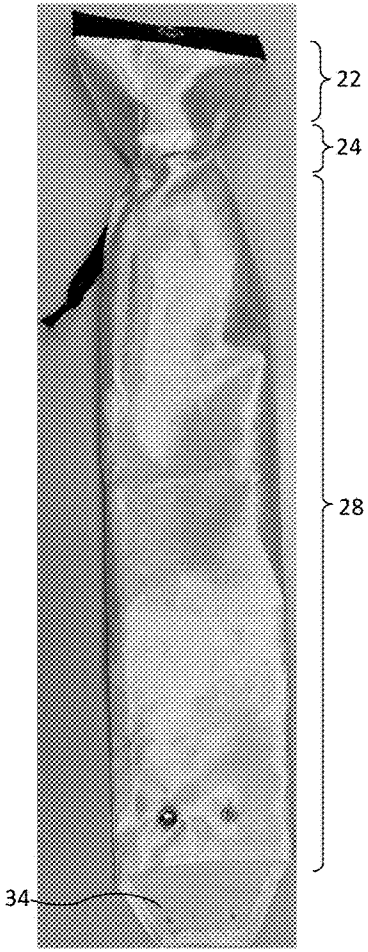
FIG. 8 is a rear view of aspects of one embodiment of the invention.
Figure 7:
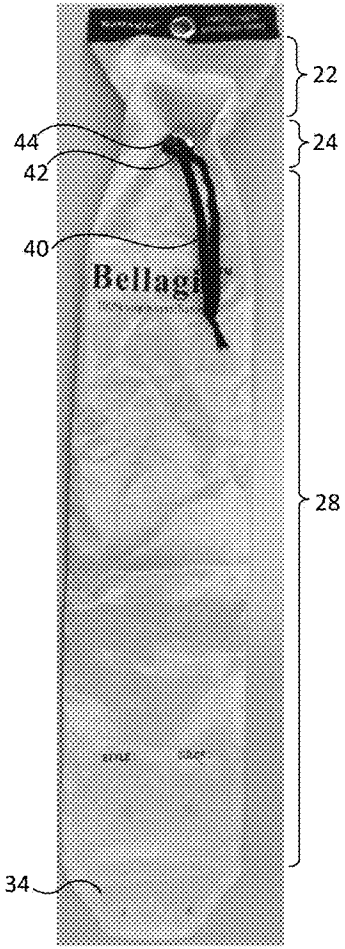
FIG. 7 is a front view of aspects of one embodiment of the invention.

FIG. 6 shows hair weave-extension material in a bundled configuration with the head 20, tie 26 and loose end 30. FIG. 7 shows the front view of one embodiment of the invention where the container is opaque with markings that include the brand name, size and style. The rope can be elastic or static. FIG. 8 is a rear view of one embodiment of the invention.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A combination hair weave-extension material with a packaging apparatus for hair weave-extension materials comprising:

a hair weave-extension material having a head, tie, and loose end and having a bundled configuration and loose configuration;

a single piece container for receiving and completely surrounding the hair weave-extension material having a front panel and a back panel defining a storage area;

a top cavity included in the storage area to receive the head of the hair weave-extension material when the hair weave-extension material is in a bundled configuration;

a cinch included in the container disposed beneath the top cavity having an open position and a closed position so that when in the closed position, the cinch is operatively associated with the container and the tie of the hair weave-extension materials to secure the hair weave-extension material in the storage area and the cinch is positioned around the tie so as not to interfere with the head and the cinch completely encloses the tie of the hair weave-extension material providing circumferential pressure around the tie and when in the open position, the hair weave-extension material can be removed from the storage area so that the hair weave-extension material can be easily removed from the storage area and replaced in the storage area;

a bottom cavity included in the storage area for receiving the loose end of the hair weave-extension material;

an opening defined below the bottom cavity allowing the hair weave-extension material to be placed in and removed from the storage area;

a flap attached to the container for covering the opening in a closed position;

a top portion attached to the container disposed above the top cavity having a hanger opening defined in the top portion for use in storing and displaying the container and hair weave-extension material in a sales environment; and, an insert included in the storage area having product information directed to the hair weave-extension material.

2. The packaging of claim 1 including:

a set of cinch openings extending through the container included in the cinch for receiving a rope that encircles the container and encircles the tie of the hair weave-extension material when the hair weave-extension material is in the container; and, a toggle spring stop for receiving the ends of the rope to secure the rope in a closed position.

3. The packaging of claim 1 including elastic included in the cinch biasing the cinch in a closed position for securing the hair weave-extension material in the container.

4. The packaging of claim 3 including cinch tabs for extending the elastic and placing the cinch in the open position to replace the hair weave-extension material in the container.

5. The packaging of claim 1 including a strap that encircles the container and encircles the tie of the hair weave-extension material when the hair weave-extension material is in the container.

6. The packaging of claim 5 including a hook and loop fastener operatively associated with the strap to secure the strap in the closed position.

7. The packaging of claim 5 including a buckle attached to the strap to secure the strap in the closed position.

* * * * *